US012042033B2

(12) United States Patent
DeJesus

(10) Patent No.: US 12,042,033 B2
(45) Date of Patent: Jul. 23, 2024

(54) COMPOSITE TOTE BAG SYSTEM

(71) Applicant: Sonia DeJesus, Mount Olive, NJ (US)

(72) Inventor: Sonia DeJesus, Mount Olive, NJ (US)

( * ) Notice: Subject to any disclaimer, the term of this patent is extended or adjusted under 35 U.S.C. 154(b) by 172 days.

(21) Appl. No.: 17/962,682

(22) Filed: Oct. 10, 2022

(65) Prior Publication Data

US 2024/0115019 A1 Apr. 11, 2024

(51) Int. Cl.
*A45C 7/00* (2006.01)
*A45C 13/10* (2006.01)

(52) U.S. Cl.
CPC ..... *A45C 7/0077* (2013.01); *A45C 7/009* (2013.01); *A45C 13/10* (2013.01)

(58) Field of Classification Search
CPC ..... A45C 7/0077; A45C 7/009; A45C 13/10
USPC ..... 383/2
See application file for complete search history.

(56) References Cited

U.S. PATENT DOCUMENTS 3,738,565 A 6/1973 Ackley et al.
3,763,628 A 10/1973 Bodolay
4,235,350 A * 11/1980 Valentino ..... A61B 50/36 220/495.1
4,754,790 A * 7/1988 Meyers ..... A45C 3/08 150/113
4,874,258 A * 10/1989 Marino ..... B65D 88/1618 383/41
5,813,445 A 9/1998 Christman
6,634,473 B1 10/2003 Wagner
8,251,113 B2 * 8/2012 Baxter ..... A45C 1/024 150/900
10,624,432 B2 * 4/2020 Gea ..... A45C 3/00
2009/0188592 A1 * 7/2009 Connacher ..... A45C 13/126 150/112
2010/0200450 A1 8/2010 Weed
2012/0074664 A1 3/2012 Henny et al.
2014/0140643 A1 * 5/2014 Li ..... A45C 11/20 383/111
2014/0150936 A1 * 6/2014 Goodale ..... A45C 3/08 150/105

FOREIGN PATENT DOCUMENTS

JP 08196321 A * 8/1996 ..... A45C 13/02
WO WO-2008043941 A2 * 4/2008 ..... A45C 1/024

* cited by examiner

*Primary Examiner* — Jes F Pascua
(74) *Attorney, Agent, or Firm* — Thomas J. Germinario

(57) ABSTRACT

A composite tote bag has a nestable, insertable, open-top plastic container for segregating items within the bag interior. The outer bag can be made of any durable, pliable cloth, such as canvas, while the inner container is preferably food-grade polyethylene. On either side, the plastic container has inset handle openings which align within the bag interior with cooperating hook-and-loop fasteners that keep the container in a stable upright position. Optionally, either or both the bag and the container can be flexibly collapsible.

4 Claims, 8 Drawing Sheets

COMPOSITE TOTE BAG SYSTEM

FIELD OF INVENTION

The present invention relates to the general field of means for manually carrying items, and more particularly to bags and containers adapted to manually carrying items.

BACKGROUND OF THE INVENTION

Tote bags, either made of canvas or plastic, are commonly used in shopping, and many state and local governments are now requiring that shoppers provide their own bags instead of using disposable plastic bags provided by stores. But while some items are compatible for carrying in one bag, others are not. For example, fresh fruits and vegetables may wilt on contact with cardboard packaging or fabric bags, while the latter may be damaged by moisture from such items. This requires shoppers to carry multiple bags into a store and awkwardly juggle these bags as they shop. In response to this problem, the present invention provides a composite tote bag, in which an impermeable plastic container is nested within an outer bag, thereby allowing the shopper to conveniently segregate items.

SUMMARY OF THE INVENTION

The present invention is a tote bag with a nestable, insertable, open-top plastic container for segregating items within the bag interior. The outer bag can be made of any durable, pliable cloth, such as canvas, while the inner container is preferably food-grade polyethylene. On either side, the plastic container has inset handle openings which align within the bag interior with cooperating hook-and-loop fasteners that keep the container in a stable upright position. Optionally, either or both the bag and the container can be flexibly collapsible.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1A:
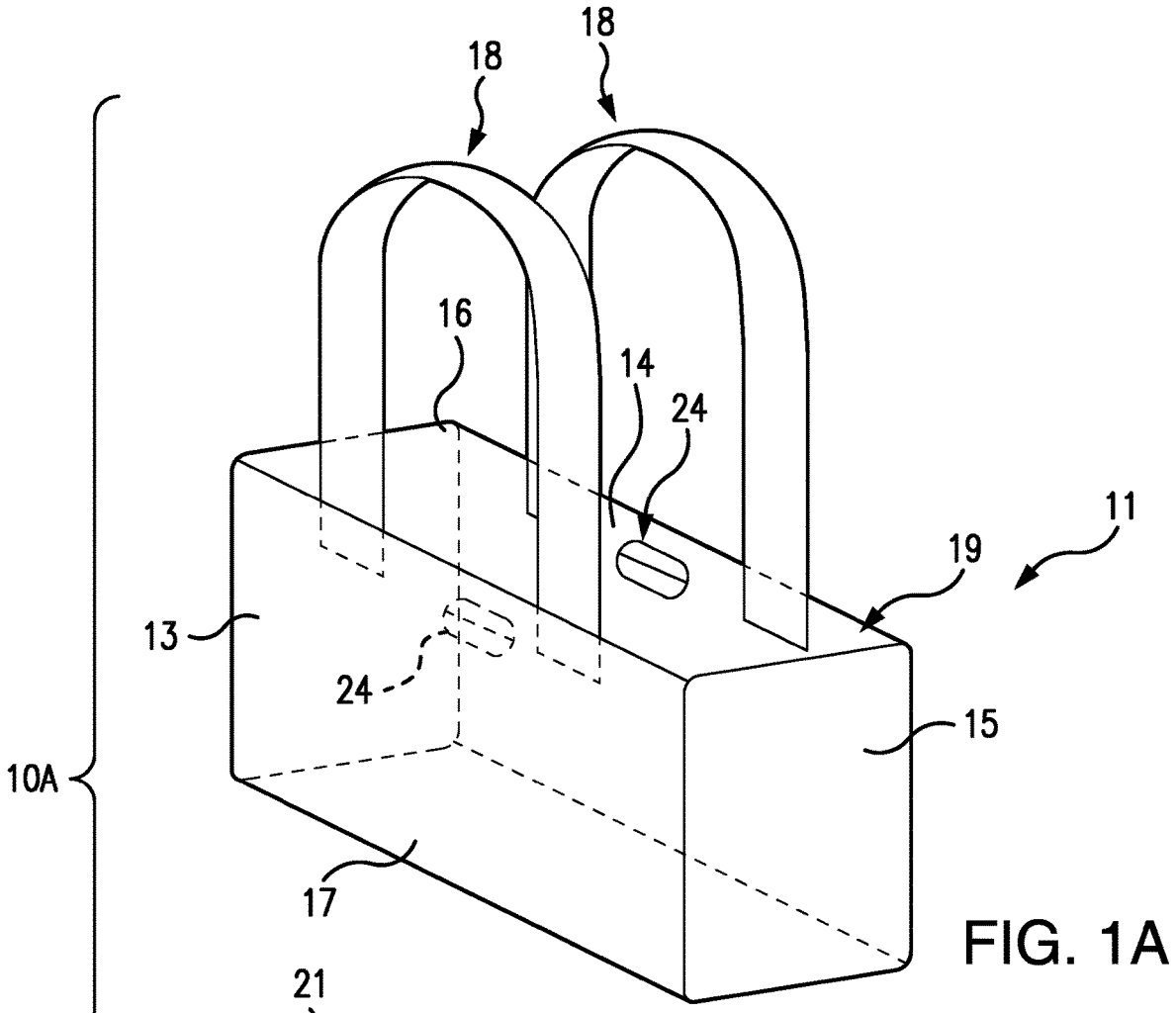
FIG. 1A is a perspective view of the bag according to the first embodiment of the present invention.

Referring to FIGS. 1A-1D, the tote bag system according to the first exemplary embodiment of the present invention 10A comprises a bag 11 and an impermeable plastic container 12. The bag 11, shown in FIG. 1A, has five pliable, interconnected generally rectangular panels, comprising two front and back opposing face panels 13 14, two right and left opposing side panels 15 16, and a base panel 17. Two bag handles 18 are attached to and extend from the two opposing face panels 13 14. In this embodiment 10, the face panels 13 14 are longer than the side panels 15 16, but it should be understood that their lengths can also be equal. The five interconnected panels 13-17 together define a bag interior 19, in which items of a first type can be carried.

Figure 1B:
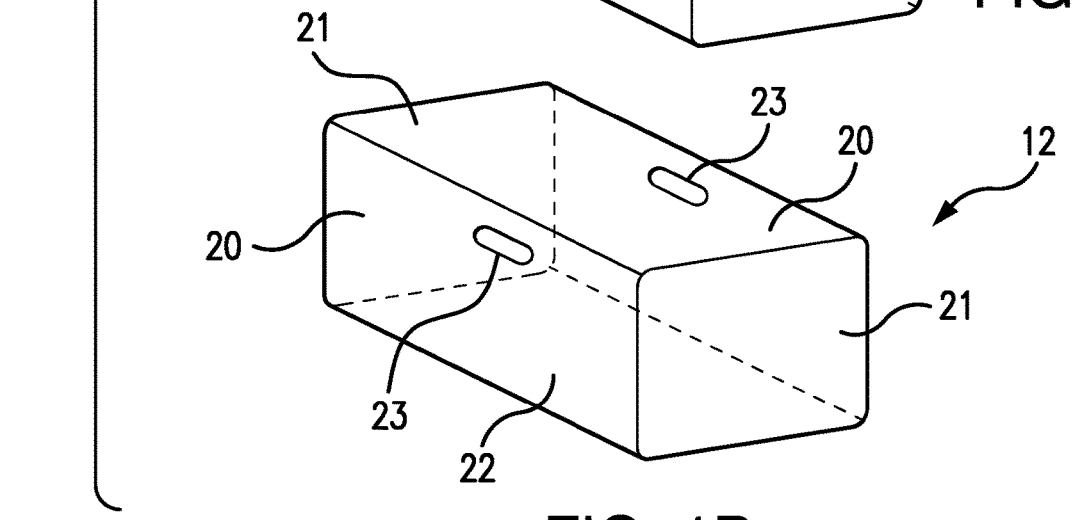
FIG. 1B is a perspective view of the plastic container according to the first embodiment of the present invention.

The plastic container 12, shown in FIG. 1B, has five rigid or semi-rigid, interconnected generally rectangular walls, comprising two opposing longitudinal walls 20, two opposing lateral walls 21, and a bottom wall 22. In this embodiment 10A, the longitudinal walls 20 are longer than the lateral walls 21, but it should be understood that their lengths can also be equal.

Figure 1C:
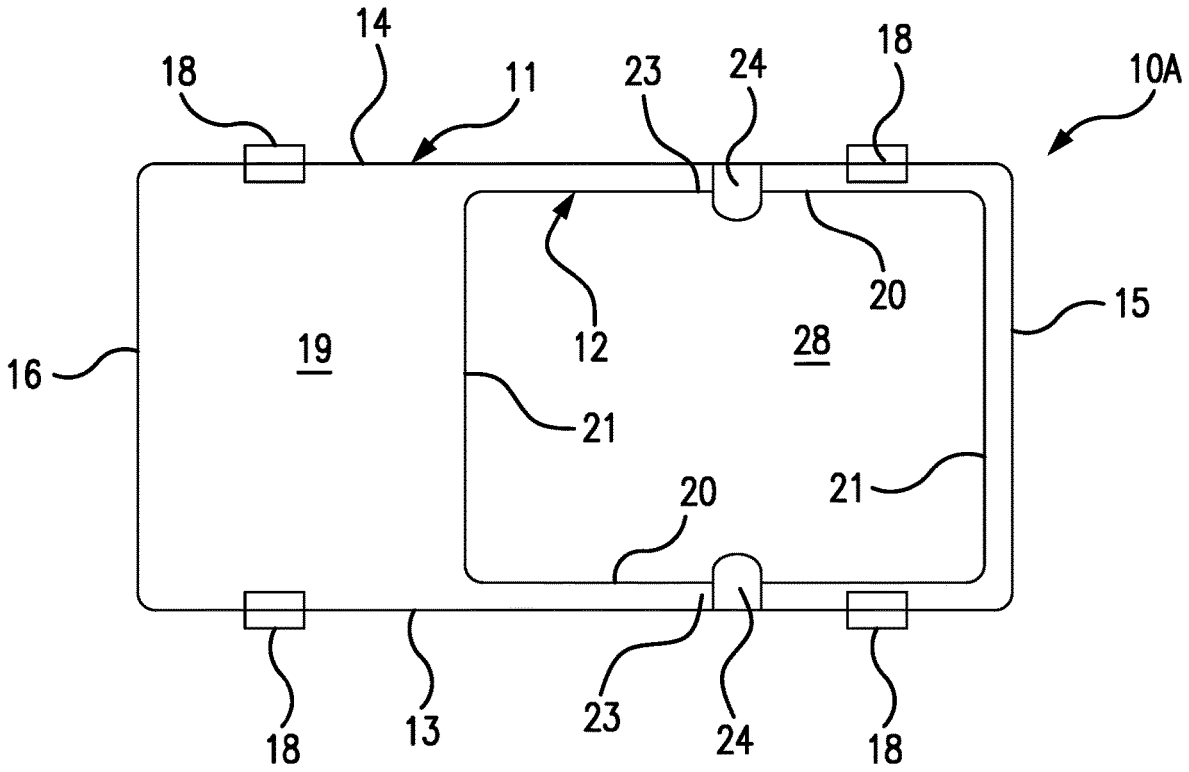
FIG. 1C is a top plan view of the plastic container nested within the bag according to the first embodiment of the present invention.
Figure 1D:
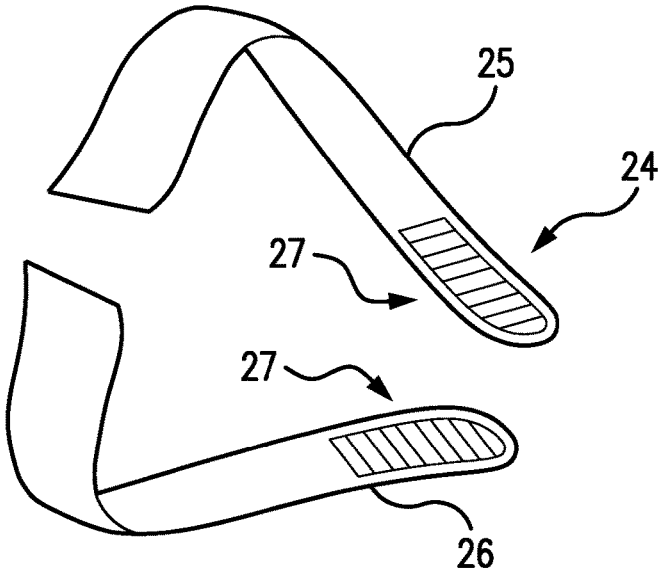
FIG. 1D is a detail view of the fastener straps according to all embodiments of the present invention.

Approximately mid-length in the longitudinal walls, the container 12 has two opposing inset openings 23, which serve double purposes as handles, when the container 12 is outside the bag 11, and as means of securing the container 12 to the face panels 13 14 when the container is inserted into the bag interior 19. As best seen in FIGS. 1C-1D, fastener straps 24 which are attached to the bag's opposing face panels 13 14 cooperatively align with the container's inset openings 23 when the container 12 is inserted into the bag interior 19.

Each of the fastener straps 24 comprises a first mating strap 25 engageable with a second mating strap 26 through one of the inset openings 23. In embodiments 10A-10D, the fastener straps 24 adhere together with a hook-and-loop connection 27, such as Velcro, but it should be understood that other connection means, such as magnets, clasps, snaps or ties can also be used. As shown in FIG. 1C, in order for the fastener straps 24 to reach through the container's inset openings 23, the length of the container's lateral walls 21 must be approximately equal to that of the bag's side panels 15 16.

The five interconnected container walls 20-22 together define a container interior 28, in which items of a second type can be carried, thereby segregating them from the items of the first type in the bag interior 19.

Figures 2A, 2B:
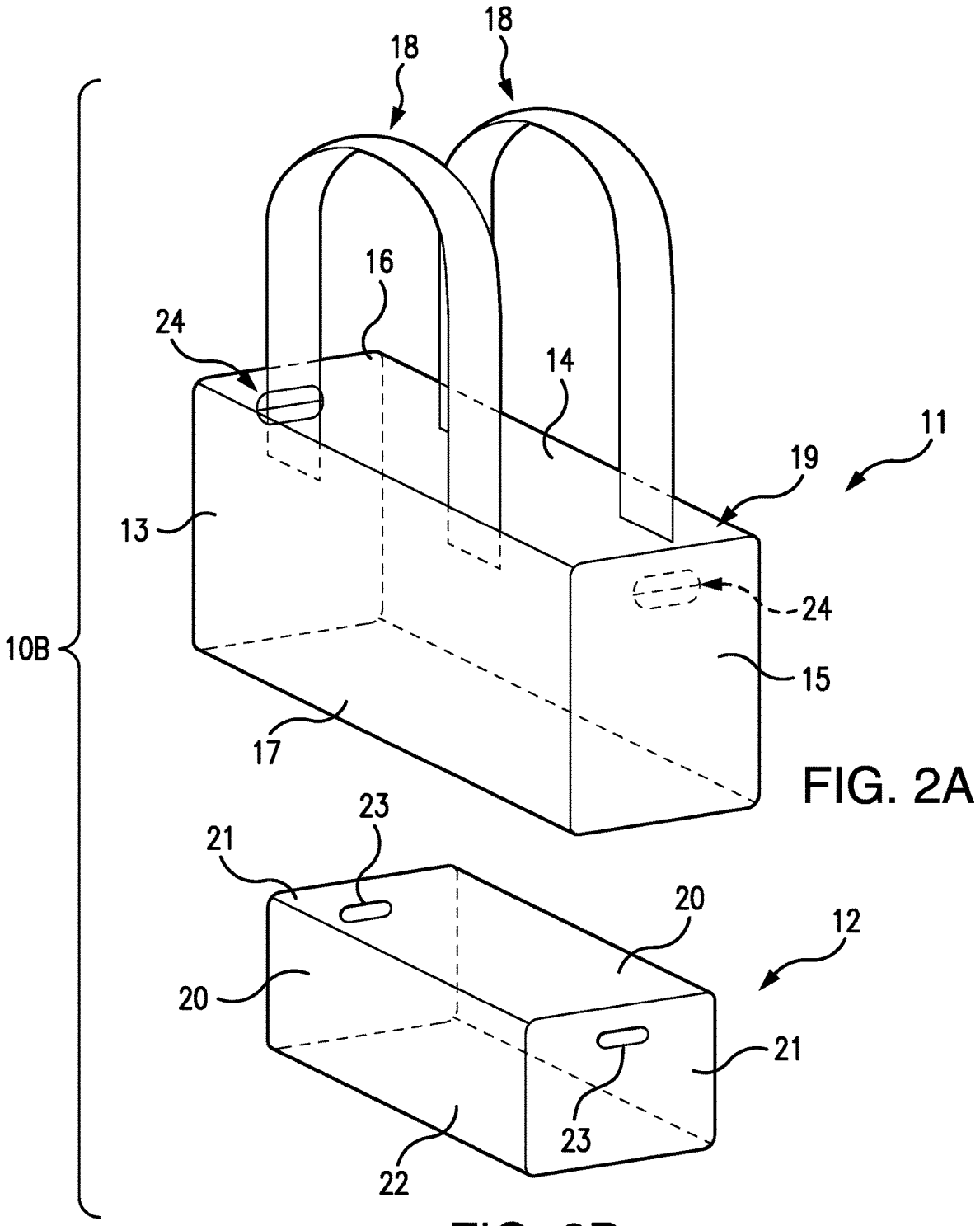
FIG. 2A is a perspective view of the bag according to the second embodiment of the present invention.
FIG. 2B is a perspective view of the container according to the second embodiment of the present invention.
Figure 2C:
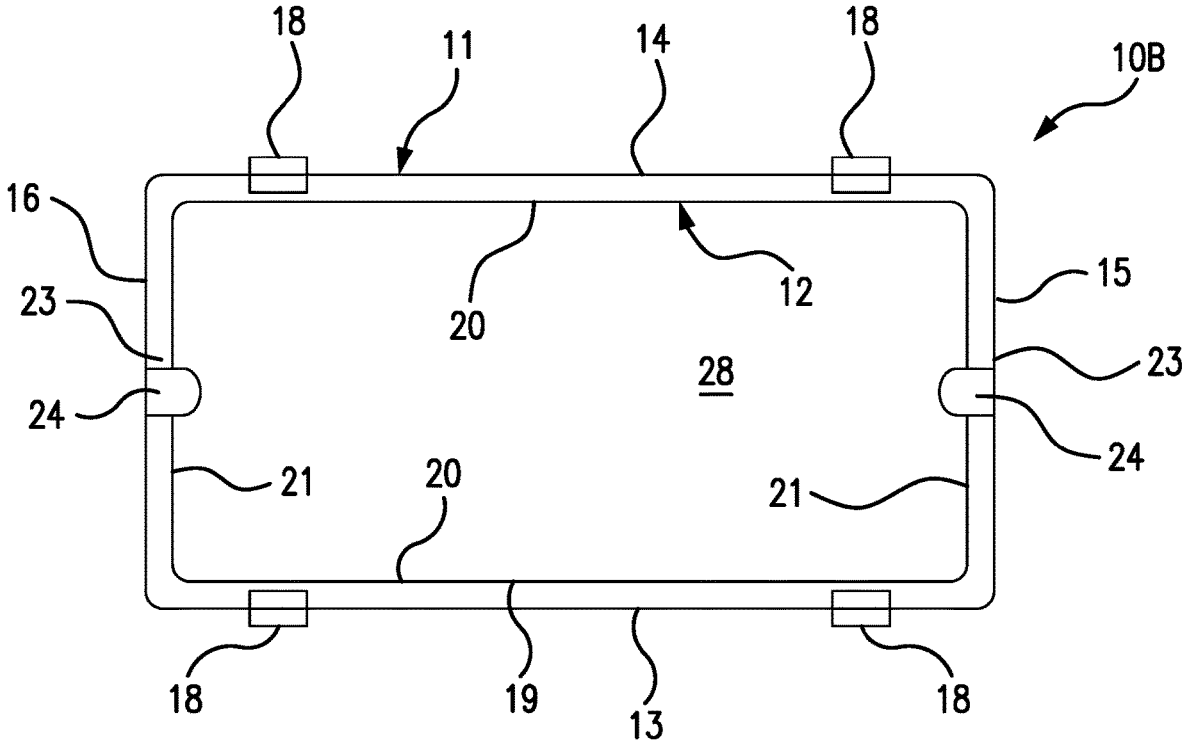
FIG. 2C is a top plan view of the plastic container nested within the bag according to the second embodiment of the present invention.

In the second embodiment of the present invention 10B, illustrated in FIGS. 2A-2C, the bag's fastener straps 24 are relocated from the bag's two opposing face panels 13 14 to the bag's two opposing side panels 15 16. Correspondingly, the container's inset openings 23 are relocated from the container's two opposing longitudinal walls 20 to the container's two opposing lateral walls 21. As shown in FIG. 2C, in order for the bag's fastener straps 24 to reach through the container's inset openings 23, the length of the container's longitudinal walls 20 must be approximately equal to that of the bag's face panels 13 14.

Figures 3A, 3B:
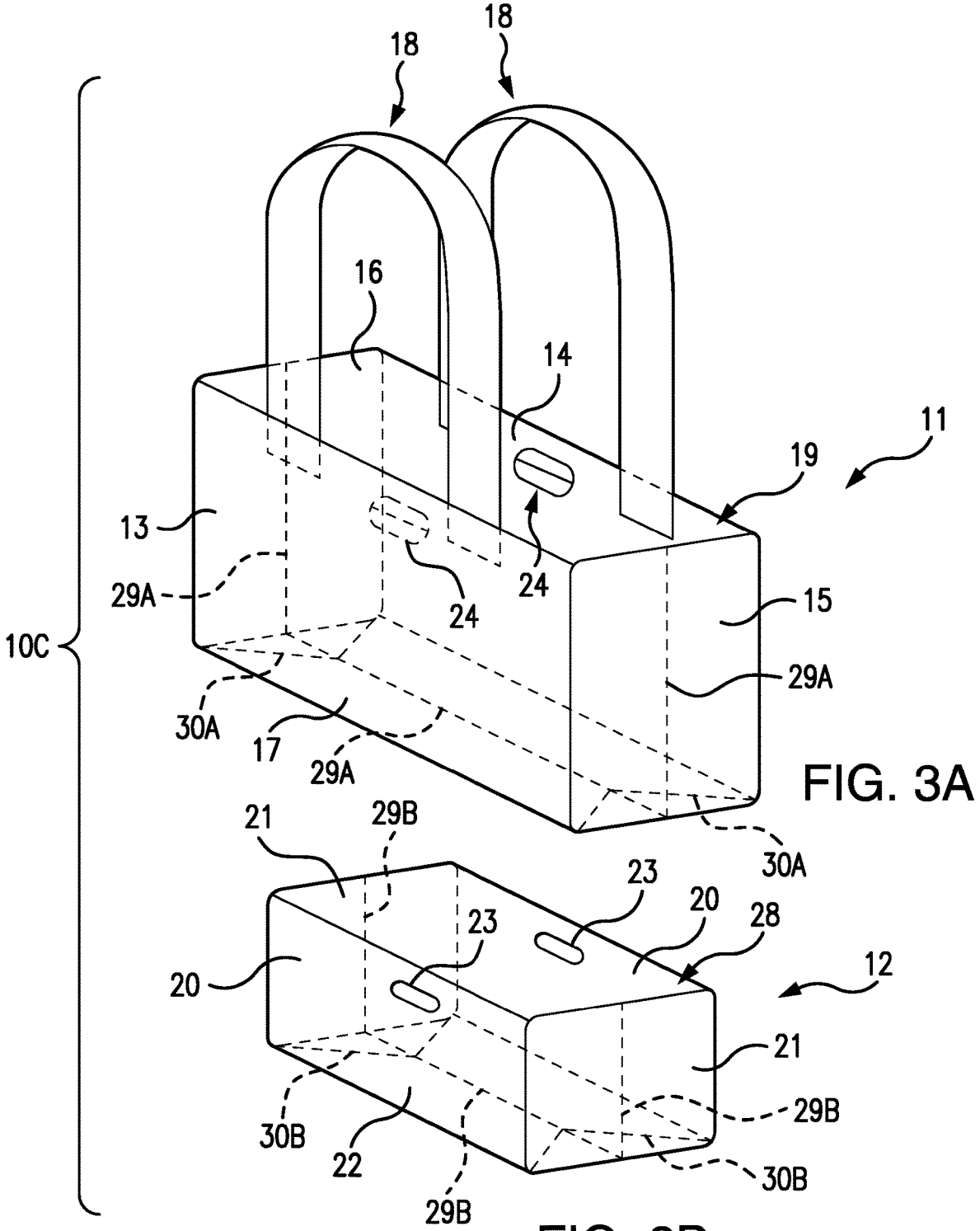
FIG. 3A is a perspective view of the bag according to the third embodiment of the present invention.
FIG. 3B is a perspective view of the plastic container according to the third embodiment of the present invention.
Figure 3C:
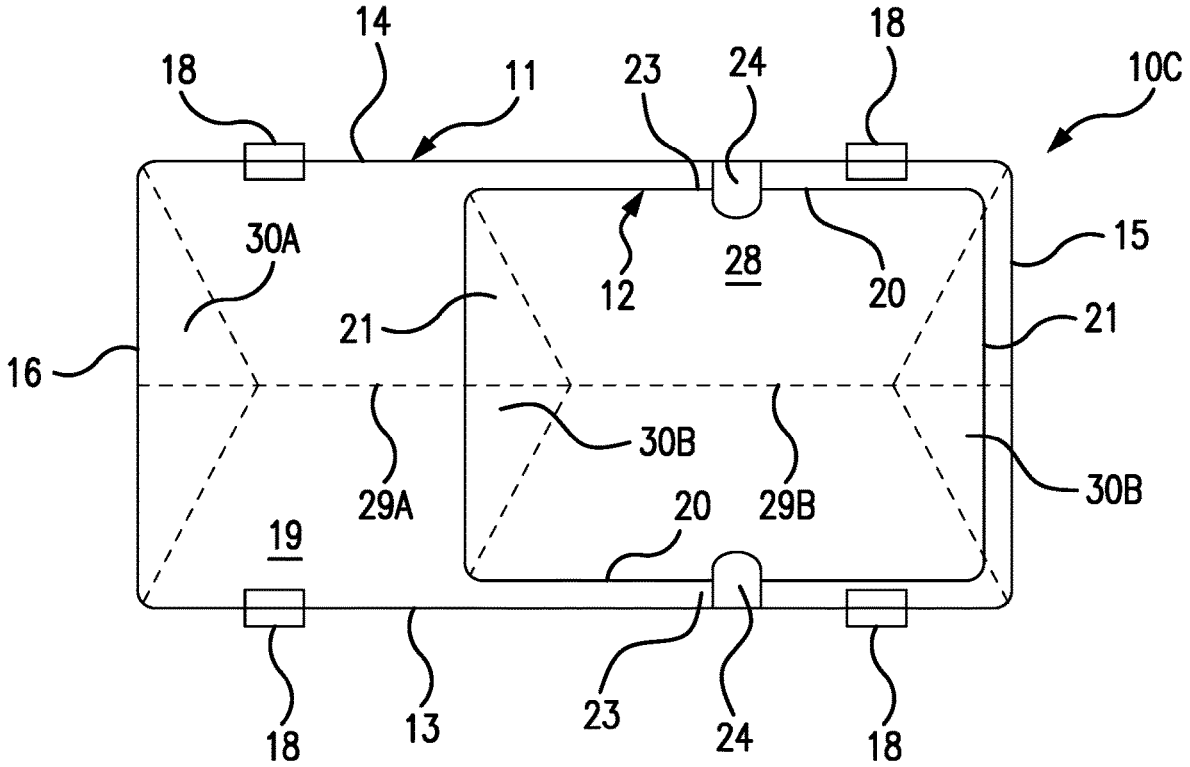
FIG. 3C is a top plan view of the plastic container nested within the bag according to the third embodiment of the present invention.

Referring now to FIGS. 3A-3B, in the third exemplary embodiment of the present invention 10C, the bag 11 and/or the plastic container 12 have pliable panels/walls, and they can be folded up, either together or separately, for compact storage. FIG. 3A depicts the bag 11 with fold lines 29A through the longitudinal centers of the two opposing side panels 15 16 and the base panel 17, in which the fold line 29A on either end bisects a triangular gusset 30A. As a result, the side panels 15 16 can be folded inward into the bag interior 19, and the base panel 17 can be folded upward into the bag interior 19, such that the two opposing face panels 13 14 are folded together, and the bag 11 is thereby flattened for compact storage.

Similarly, FIG. 3B depicts the plastic container 12 with fold lines 29B through the longitudinal centers of the two opposing lateral walls 21 and the bottom wall 22, in which the fold line 29B on either end bisects a triangular gusset 30B. As a result, the lateral walls 21 can be folded inward into the container interior 28, and the bottom wall 22 can be folded upward into the container interior 28, such that the two opposing longitudinal walls 20 are folded together, and the container 12 is thereby flattened for compact storage.

The container 12 can be flattened for storage either separately from the bag 11, or while attached within the bag 11. In the latter case, the container 12 is first detached from one of the face panels of the bag 13 by opening the corresponding pairs of fastener straps 24, and then the container 12 is folded up against the opposing face panel 14. The bag's two opposing face panels 14 are then folded together, as described above, and the entire composite tote bag 10C is thereby flattened for compact storage.

Figure 4A:
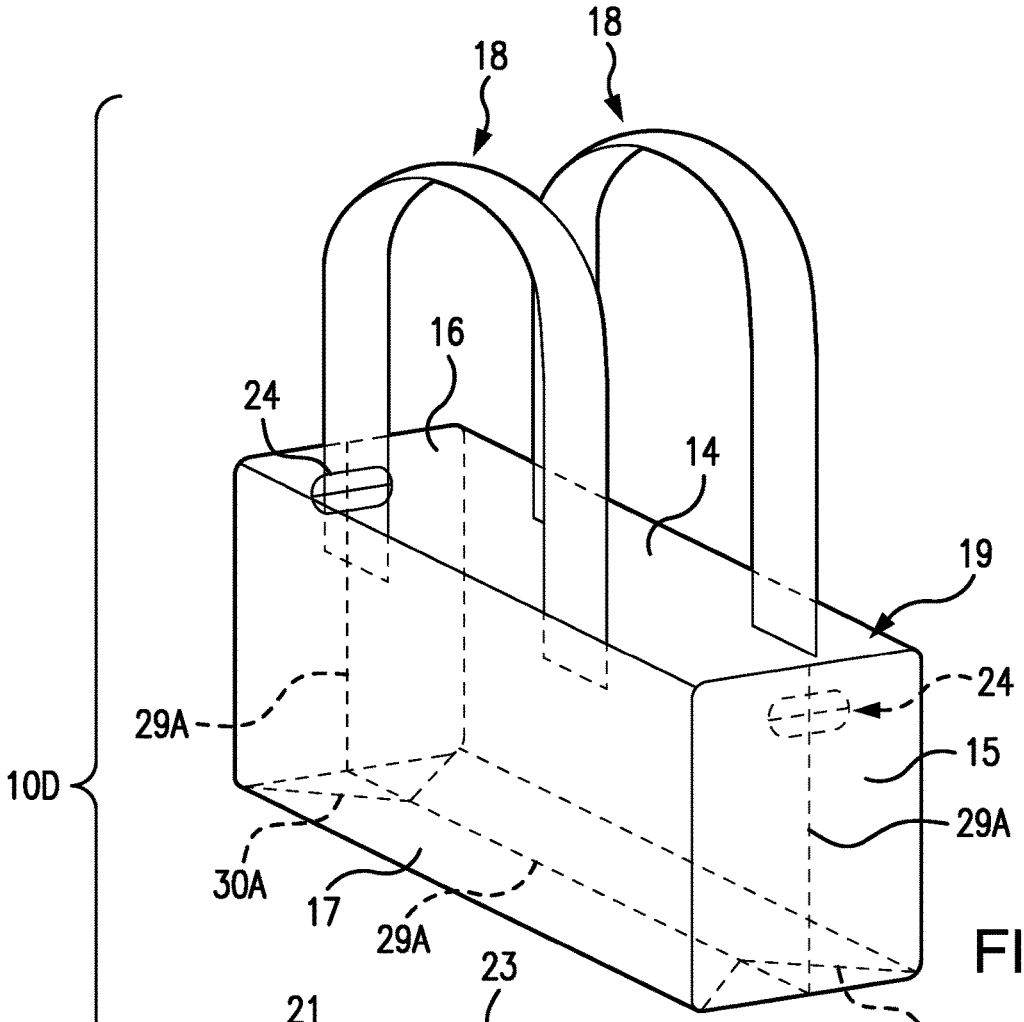
FIG. 4A is a perspective view of the bag according to the fourth embodiment of the present invention.
Figure 4B:
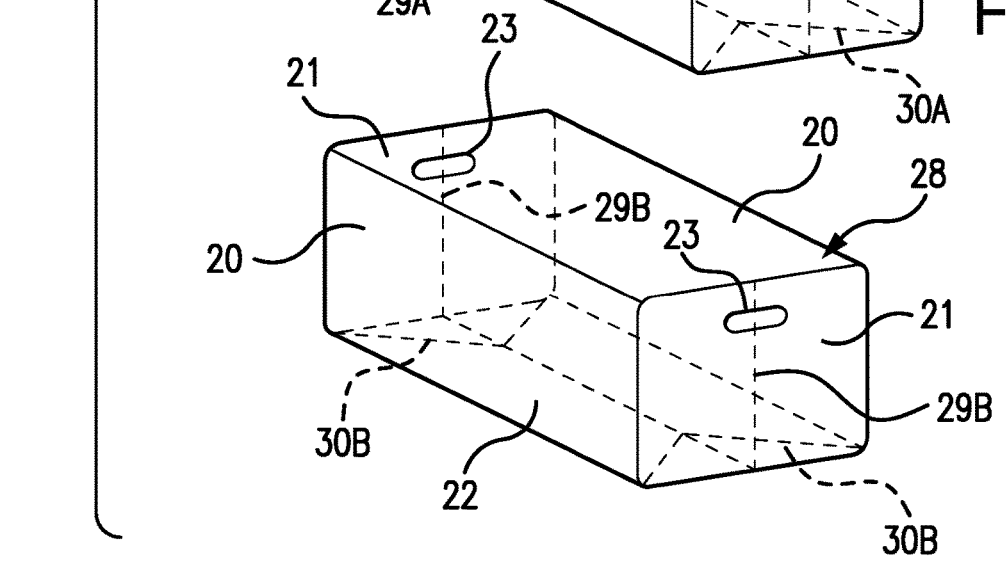
FIG. 4B is a perspective view of the plastic container according to the fourth embodiment of the present invention.
Figure 4C:
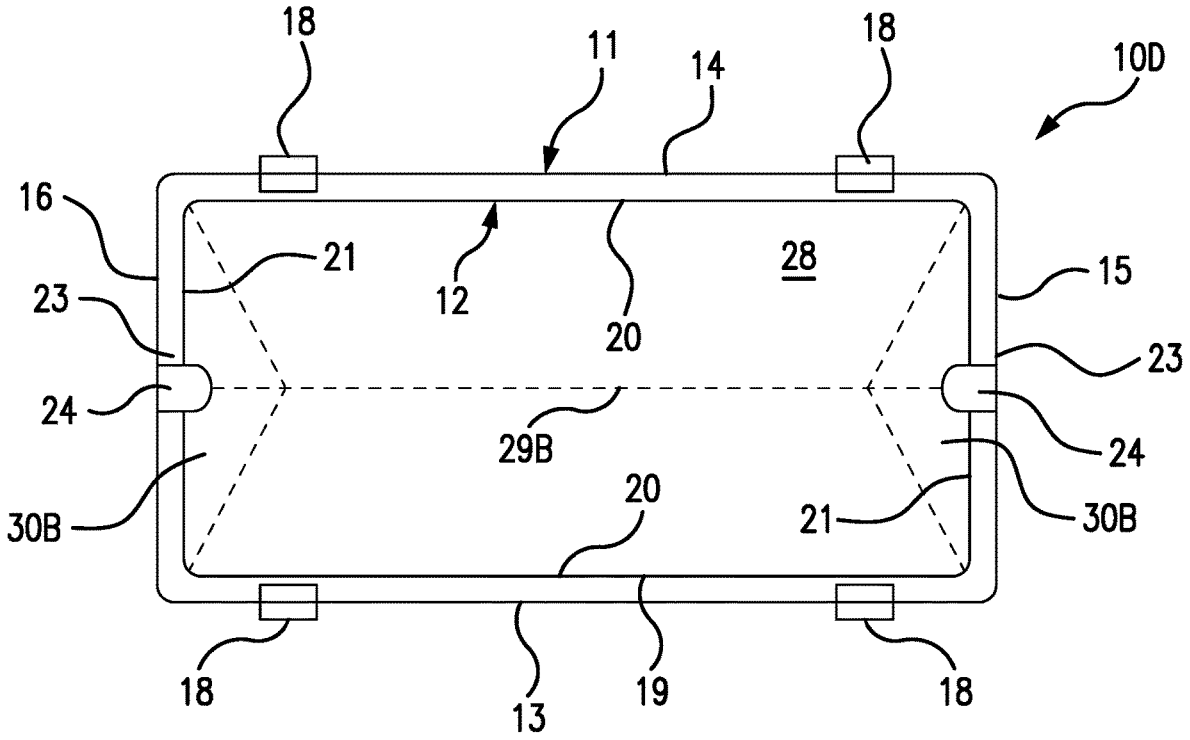
FIG. 4C is a top plan view of the plastic container nested within the bag according to the fourth embodiment of the present invention.

In the fourth embodiment of the present invention 10D, illustrated in FIGS. 4A-C, the bag 11 and container 12 are foldable, as in the third embodiment 10C, but the bag's fastener straps 24 are relocated to the bag's two opposing side panels 15 16, and the container's inset openings 23 are relocated to the container's two opposing lateral walls 21, as in the second embodiment 10B. As shown in FIG. 4C, in order for the bag's fastener straps 24 to reach through the container's inset openings 23, the length of the container's longitudinal walls 20 must be approximately equal to that of the bag's face panels 13 14.

In all four embodiments 10A-10D, the container 12 has a depth less than or equal to that of the bag 11. Optionally, the container walls 20 21 can contain perforations to prevent condensation within or outside the container 12.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A composite tote bag system comprising:

a bag comprising five pliable, interconnected rectangular panels and two bag handles, wherein the rectangular panels comprise two front and back opposing face panels, two right and left opposing side panels, and a base panel, and wherein the two bag handles are attached to and extend from the two opposing face panels, and wherein the face panels have a length that is greater than or equal to that of the side panels, and wherein the five interconnected rectangular panels define a bag interior;

an impermeable plastic container comprising five interconnected rectangular walls and two handle openings, wherein the rectangular walls comprise two opposing longitudinal walls, two opposing lateral walls, and a bottom wall, and wherein the two handle openings are inset in the two opposing longitudinal walls or in the two opposing lateral walls, and wherein the longitudinal walls have a length which is greater than or equal to that of the lateral walls, and wherein the lateral walls have a length which is equal to that of the side panels of the bag, and wherein the longitudinal walls have a length which is less than or equal to that of the face panels of the bag, such that the plastic container is removably insertable into the bag, with at least one of the lateral walls of the plastic container aligned with one of the side panels of the bag, and wherein the five interconnected rectangular walls define a container interior; and at least one pair of fasteners attached to the two opposing face panels of the bag, wherein each of the fasteners comprises a first mating connection engageable with a second mating connection, and wherein each of the fasteners align with one of the two handle openings of the plastic container when the plastic container is inserted into the bag with at least one of the lateral walls of the plastic container aligned with one of the side panels of the bag, such that the first mating connection is engageable with the second mating connection through the handle opening of the plastic container with which the fastener is aligned, thereby securing the plastic container within the bag.

2. The composite tote bag system according to claim 1, wherein the bag is gusseted, with fold lines through longitudinal centers of the two opposing side panels and of the base panel through a triangular gusset, such that the two opposing side panels are foldable inward into the bag interior, and the base panel is foldable upward into the bag interior, such that the two opposing face panels are foldable together.

3. The composite tote bag system according to claim 2, wherein the rectangular walls of the plastic container are pliable, and wherein the plastic container is gusseted, with fold lines through longitudinal centers of the two opposing lateral walls and of the bottom wall through a triangular gusset, such that the two opposing lateral walls are foldable inward into the container interior, and the bottom wall is foldable upward into the container interior, and such that, with at least one of the fasteners disengaged from the handle openings, the plastic container is foldable against one of the opposing face panels of the bag.

4. The composite tote bag system according to claim 1, wherein the rectangular walls of the plastic container are pliable, and wherein the plastic container is gusseted, with fold lines through longitudinal centers of the two opposing lateral walls and of the bottom wall through a triangular gusset, such that the two opposing lateral walls are foldable inward into the container interior, and the bottom wall is foldable upward into the container interior, and such that, with at least one of the fasteners disengaged from the handle openings, the plastic container is foldable against one of the opposing face panels of the bag.

* * * * *